United States Patent [19]

Wearing et al.

[11] 3,986,920

[45] Oct. 19, 1976

[54] TRANSFER APPLICATION DEVICE

[75] Inventors: Michael Wearing, Camberley; Michael John Kite, Sandhurst, both of England

[73] Assignees: Johnson Matthey & Co., Limited, London; C. F. Taylor (Unity Designs) Ltd., both of England; part interest to each

[22] Filed: Apr. 25, 1975

[21] Appl. No.: 571,745

Related U.S. Application Data

[63] Continuation-in-part of Ser. No. 349,188, April 9, 1973, abandoned.

[52] U.S. Cl. ..... 156/568; 156/572; 156/584

[51] Int. Cl.[2] ..... B65C 9/04; B65C 9/14

[58] Field of Search ..... 156/566, 567, 568, 570, 571, 156/572, 556, 541, 542, 230, 247, 285, DIG. 1, DIG. 2, DIG. 26, DIG. 31

[56] References Cited

UNITED STATES PATENTS

| | | | |
|---|---|---|---|
| 2,667,003 | 1/1954 | VanHofe | 156/540 |
| 2,878,953 | 3/1959 | Mitchell | 156/571 |
| 3,031,370 | 4/1962 | Shank, Jr. | 156/567 |
| 3,064,714 | 11/1962 | Flood | 156/542 |
| 3,516,297 | 6/1970 | Dullinger | 156/567 |

*Primary Examiner*—William A. Powell
*Assistant Examiner*—Michael W. Ball
*Attorney, Agent, or Firm*—Cushman, Darby & Cushman

[57] ABSTRACT

This invention refers to a machine for applying transfer-designs to a substrate or a succession of substrates. Basically the machine includes a magazine for holding a stack of stick-down transfers, means for withdrawing one transfer from a stack and positioning it adjacent but in spaced relation to the substrate, means for bringing the transfer into contact with the substrate so that the transfer is applied to and remains on the substrate and means for subsequently removing the backing sheet from the transfer when so positioned on the substrate.

13 Claims, 13 Drawing Figures

FIG.2.
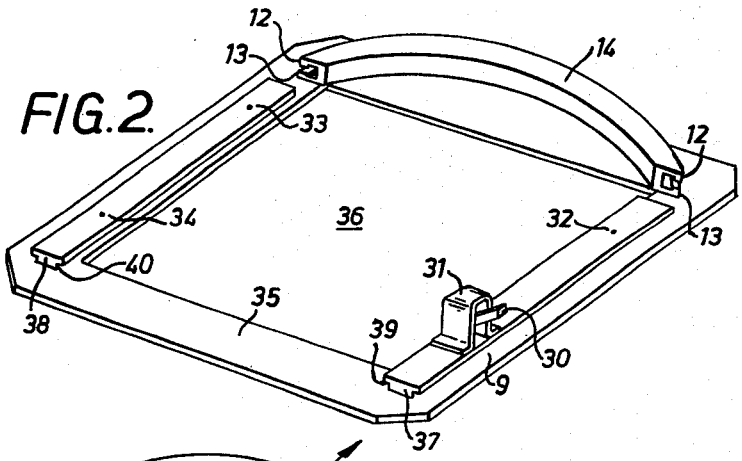
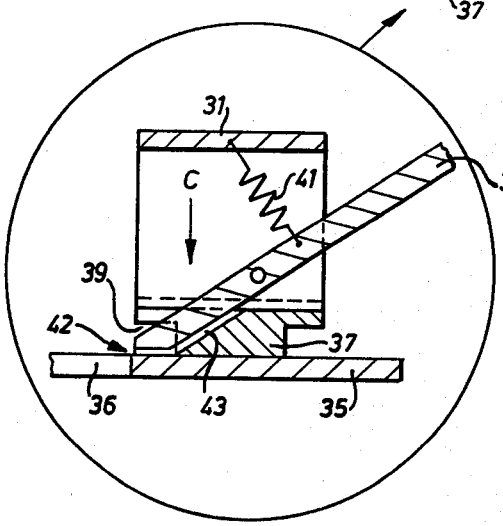
FIG.3.
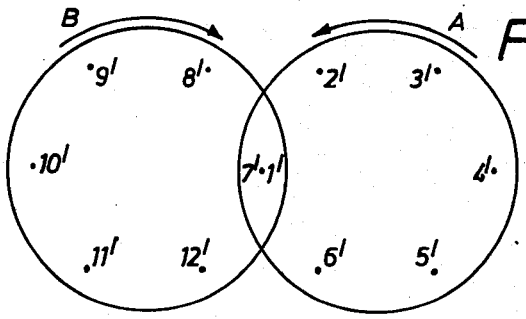
FIG.4.

FIG. 5a.
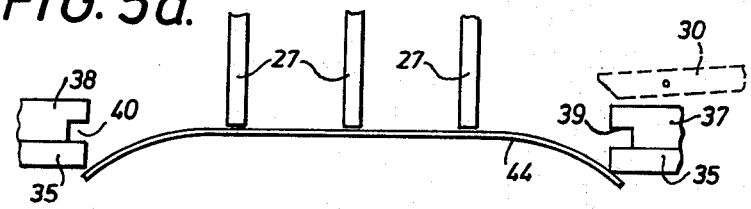
FIG. 5b.
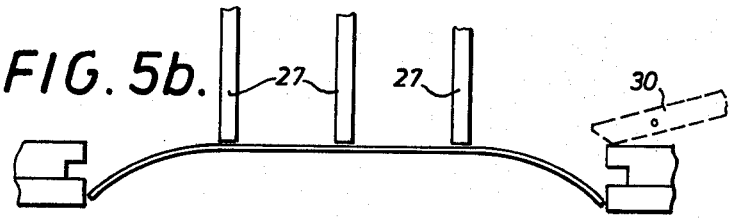
FIG. 5c.
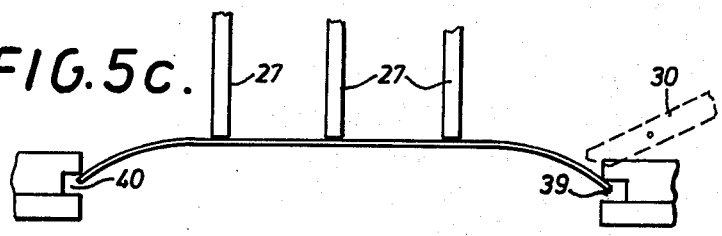
FIG. 5d.
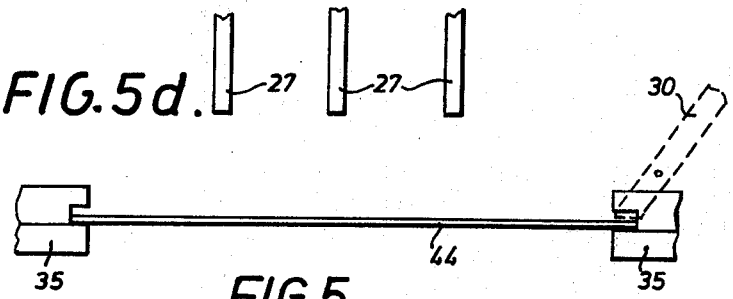
FIG. 5.

TRANSFER APPLICATION DEVICE

This is a continuation-in-part of application Ser. No. 349,188, filed Apr. 9, 1973, now abandoned.

This invention relates to machines for applying transfer-designs to substrates. It is especially, but not exclusively, concerned with such machines for applying transfer designs to unheated ceramic ware and to unheated glass-ware.

By "transfer-design" throughout this specification is meant all or part of that section of a transfer or decalcomania which may be transferred from the transfer proper to a substrate. A transfer-design although generally decorative, is not necessarily so. It may, for example, comprise a printed electrical circuit and/or a material having resistive or other desired electrical properties.

The "section of a transfer or decalcomania" referred to above is generally known in the art as the "design layer" of a transfer or decalcomania and, where appropriate and where the whole layer is meant, will be so referred to in this specification. Further, throughout the remainder of this specification and for convenience, the word transfer (or transfers) will be used whenever "transfer or decalcomania" (or transfers or decalcomanias) is meant.

Transfers generally comprise a flexible backing sheet which is usually of paper, a design layer and an adhesive material or a material capable of being rendered adhesive, whereby the transfer-design may be caused to adhere to a substrate to which it is to be transferred.

In a first type of transfer, that side of the design layer remote from the backing sheet is provided with a flexible support layer or "covercoat". This is provided to give temporary support to a transfer-design during its transfer from the backing sheet to the substrate to which it is to be applied. A typical transfer of this type will be provided with an interlayer of water-soluble gum between the design layer and the backing sheet and, in use, the transfer will be soaked in water to render the transfer-design readily removable from the backing sheet. Following this the transfer-design will either be lifted from the backing sheet and applied covercoat up to the substrate to be decorated or else the transfer will be placed on the substrate, backing sheet downwards, and the transfer design slid into position on the substrate from the backing sheet. In either case, the transfer-design is caused to adhere to the substrate by the water-soluble gum remaining on its under-surface.

In a second type of transfer no covercoat is provided and the adhesive material or the material capable of being rendered adhesive is such and is so arranged that the transfer may be applied, backing sheet up, to a substrate so as to cause the transfer-design to adhere to the substrate. Following this, the backing sheet is removed leaving the transfer design adhering to the substrate. It is with transfers of this second type that the machine of the invention is intended to be used.

Transfers of the second type are generally known as stick-down transfers and are so referred to throughout the remainder of this specification. A typical stick-down transfer will be provided with a layer of water-soluble gum on and/or embodied in the design layer and in use, the transfer will be soaked in water to activate the gum and then applied, backing sheet up, to the substrate. Following this the transfer will be rubbed down on to the substrate to cause the transfer-design to adhere to it and the backing sheet then lifted off the substrate leaving the transfer-design adhering to the latter.

Other types of stick-down transfer have pressure-sensitive adhesive on and/or in the design layer or, in place of this adhesive an adhesive which may be activated by heat. A transfer comprising a heat-activated adhesive of the type described in out co-pending British Patent Application No. 8361/72, now British Patent Specification No. 1423137 is especially suitable for use with a machine according to the present invention. The adhesive of such a transfer will remain inactive and tack-free until its temperature is raised above a certain threshold value. After activation in this way the adhesive will remain tacky for a length of time ranging from a minute or two to many hours depending upon the precise composition of the adhesive. Other stick-down transfers may incorporate chemically activated adhesives or adhesives which may be activated by exposure to sources of other types of energy such as, for example, sources of ultra-violet radiation, infra-red radiation or ultra-sonic sound.

According to one aspect of the invention a machine for applying transfer-designs to a substrate or to a succession of substrates comprises a magazine for holding a stack of stick-down transfers, means for withdrawing one transfer from the stack and positioning said transfer adjacent but in spaced relation to a substrate, means for bringing the transfer into contact with the substrate so that the transfer design is applied to and remains on said substrate and means for subsequently removing the backing sheet from the transfer.

The machine when for use with stick-down transfers incorporating an adhesive which needs to be activated also includes means for activating the adhesive of each transfer prior to its application to the substrate.

The machine in one of its preferred forms comprises a plurality of radial arms mounted equiangularly spaced around a central shaft, a transfer holder mounted on each arm, means for indexing the arms through an angular distance equal to the angular separation of any two successive arms, a plurality of ware carriers for holding ceramic ware or other articles to which the transfer-designs are to be applied, means for intermittently moving the ware carriers so that each item of ware or each article is held stationary in succession adjacent but in spaced relation to a transfer holder carried by a radial arm when said arm is stationary in one of its index positions, means at successive index positions of said radial arms (a) for withdrawing a transfer from a stack of stick-down transfers and conveying said transfer to said transfer holder, (b) for exposing said transfer in said transfer holder to a source of heat so as to activate a heatactivatable adhesive of said transfer, and (c) for removing the transfer from said holder and bringing said transfer into contact, backing sheet up, with an article in said ware carrier to provide at least tacked adhesion to the ware, means located at a subsequent stationary position of the ware carrier for applying pressure to the backing sheet so as to secure the transfer design to the article and means for removing the backing sheet from the transfer.

One form of machine according to the invention will now be described by way of example only, with reference to the accompanying drawings of which:

FIG. 2 is an isometric view of a transfer holder;

FIG. 3 is a part diagrammatic sectional view of a rocking clamp which forms part of the transfer holder;

FIG. 4 is a diagrammatic representation of the index positions of the transfer carrying arms and article holders of the machine;

FIGS. 5a - 5d are diagrammatic representations of the lifting of a transfer from a stack of transfers into a transfer holder;

Figure 1:
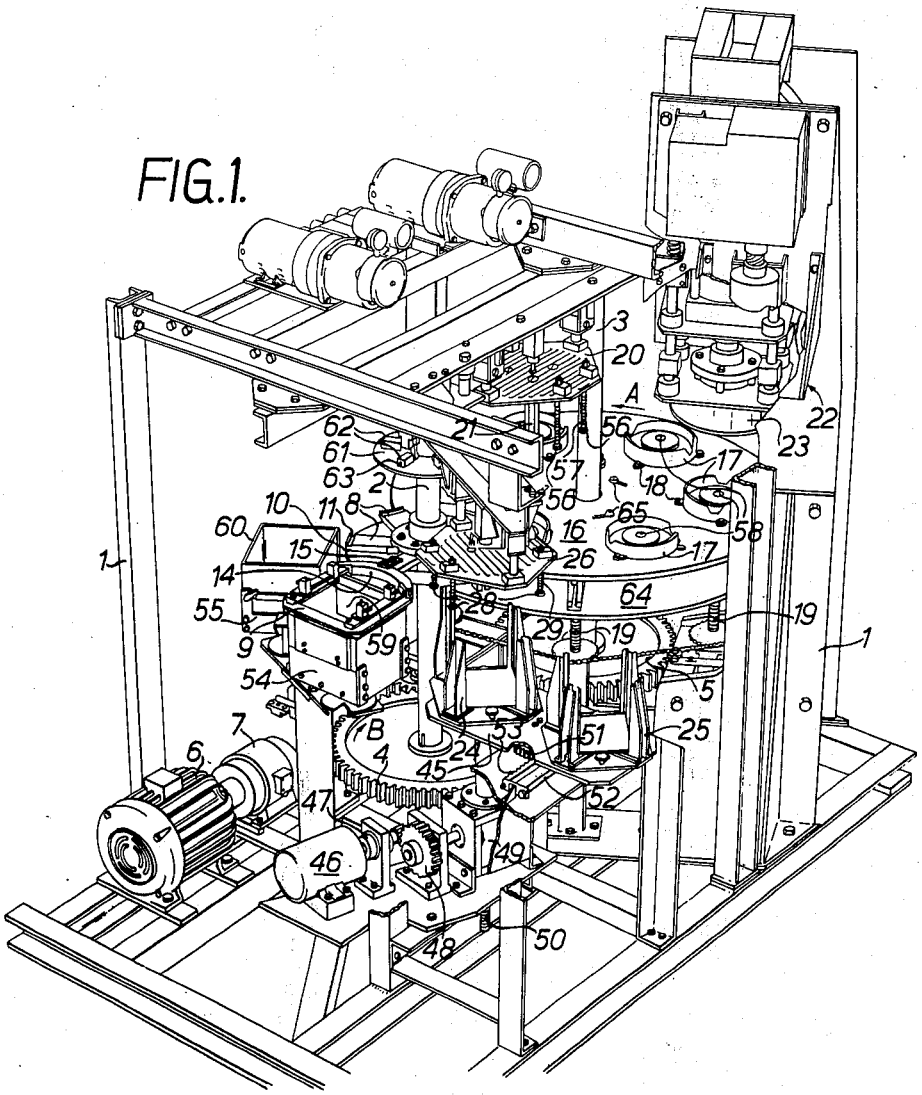
FIG. 1 is a part sectional isometric view of the machine.
Figure 6:
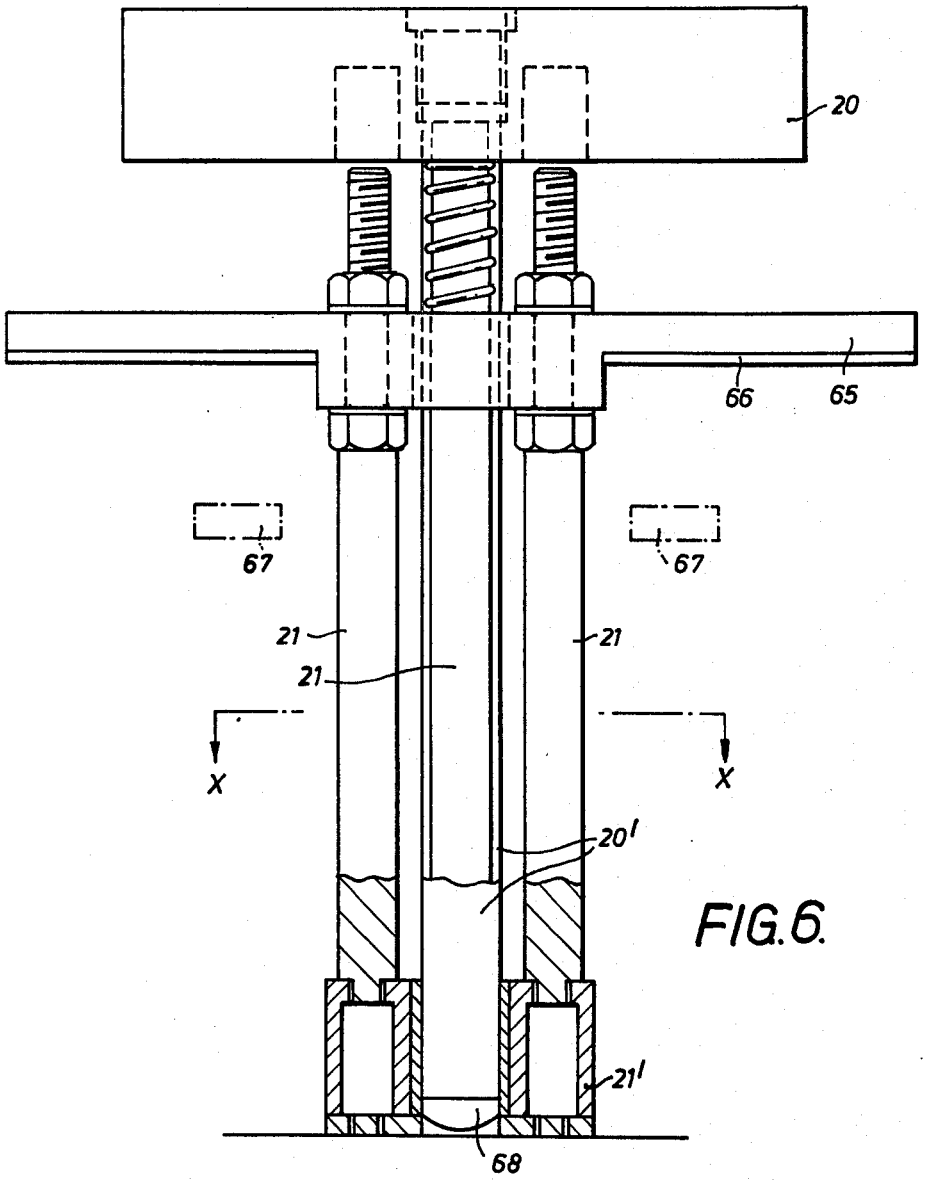
FIG. 6 is a diagrammatic part sectional view of a suction gallery and tack-down assembly.
Figure 7:
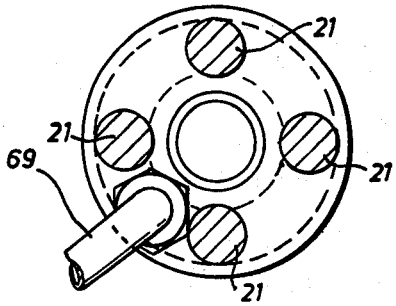
FIG. 7 is a section taken on X—X of a FIG. 6.
Figure 8:
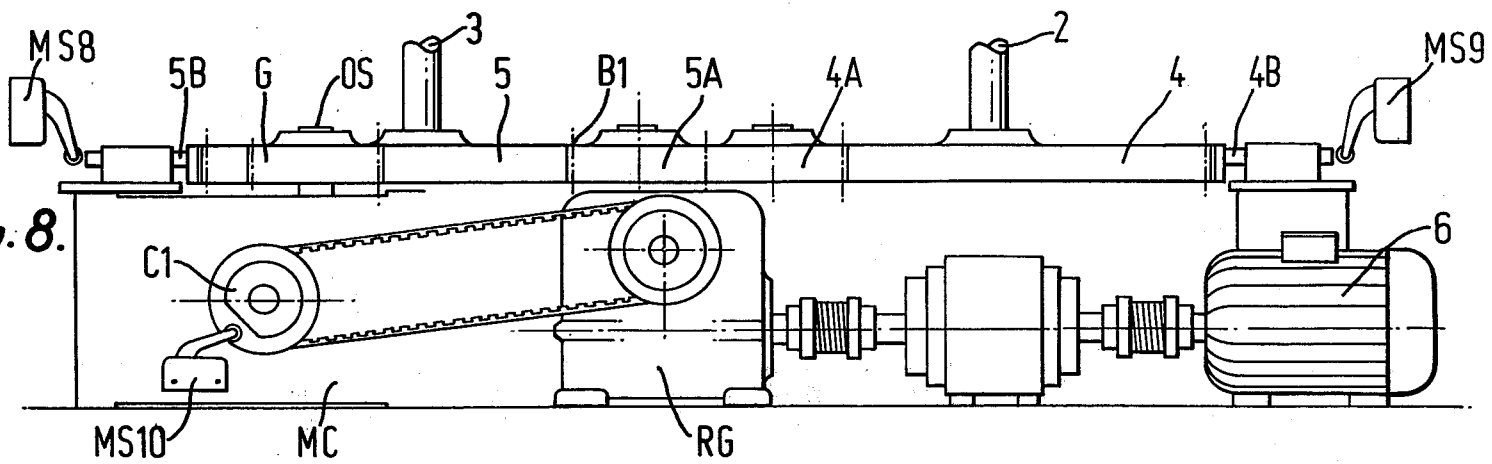
FIGS. 8 and 9 show in an enlarged scale, side and plan views of an indexing drive arrangement for the machine.
Figure 9:
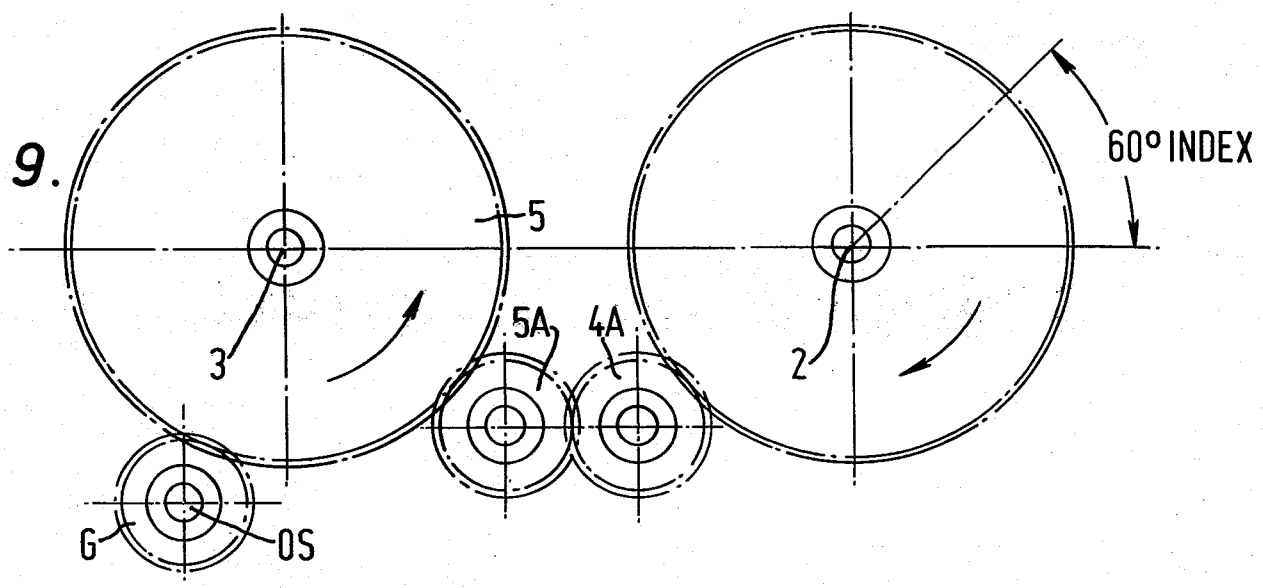

Referring now to FIGS. 1, 8 and 9, the machine consists of a rigid girder framework generally designated 1, in which are mounted in self-aligning flanged transmission bearings (not shown) vertical shafts 2 and 3. On shafts 2 and 3 are mounted 66-tooth gear wheels 4 and 5 which are meshed with a pair of meshing idler gear wheels 4A, 5A (FIGS. 8/9) so that when shaft 3 is driven in an anti-clockwise direction viewed from above, shaft 2 is driven at the same speed in a clockwise direction. The machine is driven by an electric motor 6 via a clutch/brake unit 7 and a 10-1 reduction worm gear box RG (FIGS. 8/9) from which a manifold cam indexing gear box MC (FIGS. 8/9) is driven by a belt B1. On the output shaft OS of the cam indexing gear box MC is mounted a 33-tooth gear wheel G — FIGS. 8/9 which meshes with the gear wheel 5, the whole being arranged so that when the motor 6 is running and the clutch 7 suitably engaged and disengaged, shafts 2 and 3 are indexed in 60° steps. At the end of each indexing movement shafts 2 and 3 are each locked in position by means of steel locking teeth 4B and 5B which are controlled by microswitches MS8 and MS9 and which firmly engage the teeth of the gear wheels 4 and 5 respectively. As indicated in FIG. 8, the cam indexing gear box MC has an associated cam C and microswitch MS10. The cam operates the microswitch once per revolution and has four functions, namely, a. It ensures that no other operation can take place while the machine is indexing;

b. It holds the clutch/brake unit 7 in a driving condition once the indexing has started;

c. It stops the motor 6 and releases the clutch/brake unit 7 when the correct indexing has been reached, and d. It finally releases the locking teeth 4B and 5B into the gear drive to accurately locate and lock the gear train in its correct position.

Mounted on shaft 2 is an array of six arms 8 arranged at 60° intervals, although only three of the arms are visible in the figure. At the end of each arm are arcuate grooves 10, 11 which accept the opposed edges of slot-defining walls 12, 13 of an arcuate C-section girder 14 secured to the frame of a transfer holder 9 (see also FIG. 2). The edges of the slot-defining walls of the C-section girder 14 are a smooth fit in the grooves 10, 11 of the arm 8 and this permits the transfer holder 9 to be oriented in relation to the axis of the arm 8. As shown in FIG. 1, the girder 14, and, hence, the transfer holder 9 are locked in position on the arm 8 by means of a clamping bar 15. One transfer holder 9 is shown mounted on one only of the arms 8 in FIG. 1, but, in practice, such a transfer holder is secured to the end of each of the six arms 8.

A circular table 16 is secured to a further circular table 64 which is then secured to shaft 3. Table 16 carries on its upper surface six holders 17 designed to hold articles to which transfer designs are to be applied. The holders are secured to the table 16 by means of bolts 18. The holders shown in FIG. 1 were designed to accept 7 inch diameter tea plates and for different articles, other holders would have to be fitted. The table 64 and the associated table 16 are capable of being raised and lowered twelve inches by means of screw jacks 19. In one embodiment of the invention, table 16 consists of an aluminium alloy disc 42 inches in diameter and 0.5 inch thick sandwiched between two discs of 18 gauge toughened stainless steel.

In operation the table 16 carrying the holders 17 is indexed in 60° steps in the direction of the arrow A (see also FIG. 4) so that the holders located in positions 2′, 3′, 4′, 5′ and 6′ are moved successively into position 1′.

At the same time, the arms 8 are indexed in 60° steps in the direction of arrow B so that the transfer holders 9 secured to the ends of the arms are moved successively from positions 8′, 9′, 10′, 11′ and 12′ into position 7′.

Further, the table 16 may be oriented ± 15° in relation to the index positions of table 64 by means of a vernier device (not shown) to enable a chosen part of each article holder 17 and hence of each article, when the holders are loaded, to be located beneath the transfer holder when the table 16 and the arms 8 are stationary in successive index positions. The table 16 is locked in position in relation to table 64 by means of nuts 65.

When the machine is in normal operation, a transfer holder in position 7′ will be holding a transfer stationary and immediately above the article — say a 7 inch diameter tea plate — to which the transfer design is to be applied. The plate will have been loaded at position 3′; the transfer will have been loaded into the holder 9 at position 11′ and its adhesive activated at positions 10′ and 9′. Both of these latter two positions are automatic and will be explained later.

At position 7′ a transfer applying frame 20 carrying a tack-down plunger 20′ and four rods 21 to which is secured an annular suction gallery 21′ is displaced downwards so that the gallery 21′ is moved through the appropriate transfer holder 9. During its passage downwards, the lower surface of the gallery makes contact with the grasps the back of the transfer by suction through a series of holes in the base of the gallery. The transfer is then released from the holder 9 (in a manner to be explained) and, securely held to the base of the gallery, is moved downwards until it is within about 1/16 inch of the ware. At this point the rubber pad 66 on bracket 65 makes contact with bars 67 fixed to the transfer holding frame and the downward movement of the suction gallery 21′ is arrested. The plunger 20′ carries on for another ⅛ inch so that the rubber pad 68 secured to its lower end presses part of the transfer on to the ware and "tacks" it down there, that is, causes it to adhere to the ware at that point. Just before that part of the transfer which is is in contact with the pad 68 is pressed on to the ware, a microswitch (not shown) is operated and the vacuum applied at 69 is broken so as to release the transfer from the suction holes in the gallery 21′ and the transfer applying frame 20 is then raised to its original position.

The whole process is then repeated when transfer and ware holders have been indexed from positions 8′ and 2′ into position 7′ and 1′ and so on. The ware to which the transfer is tacked in position 1′ moves successively into positions 6′ and 5′ and in position 5′ (6′ is spare) the transfer is firmly pressed on to the ware by means of a flexible pressure pad 23 secured to the end of a plunger arm in a pressure pad assembly 22 so that the transfer design is firmly secured to the ware. The pressure pad 23 is raised; the backing sheet of the transfer is removed by a blast of high pressure air from tubes (not shown) aligned at a small angle to the surface of the ware and collected by a vacuum suction device (not shown). Following this the plate in its holder and carrying the freshly applied transfer design is indexed into position 4′ where it is removed from the holder.

Returning now to the arrangements for loading transfers into transfer holders 9 and for activating the adhesive of these transfers, loading is accomplished at position 11′. In this position is located a magazine 24 for holding a stack of accurately cut stick-down transfers arranged backing sheet upwards and, immediately above the magazine, is a transfer lifting frame 26 which operates in the opposite mode to the transfer applying frame 20.

When a transfer holder 9 is in position 11′ (no holder is shown in this position in FIG. 1) it is located between the magazine 24 and the transfer lifting frame 26. As soon as the arm carrying the transfer holder comes to rest the frame 26 is lowered so that suction tubes 27 are passed down through holder 9 and make contact with and grip the backing sheet of the transfer at the top of the pile in magazine 24. During the downwards motion of frame 26, the feet 28 of four spring-loaded arms 29 make contact with and depress the outer ends of arms 30 of four spring-loaded rocking clamps 31. One such rocking-clamp is shown in greater detail in FIGS. 2 and 3. Additional rocking-clamps would be located at positions 32, 33 and 34 on the transfer holder 9 shown in FIG. 2.

As will be seen from FIG. 2, the transfer holder consists of a frame 35 with a central rectangular aperture 36 and, positioned along the sides of the frame so as to be essentially parallel with the radial arm 8 (FIG. 1) to which the frame 9 is attached, are two T-section girders 37 and 38. These are so positioned as to form grooves 39, 40 running along opposed inner edges of the frame 35. As shown diagrammatically in FIG. 3 the arm 30 is spring loaded in direction C by means of a spring 41 so that the arm will tend to grip anything located at position 42 between its lower end and the upper surface of the frame 35. As shown in FIG. 3, a suitable shaped groove 43 is formed in the T-section girder 37 to accommodate the lower end of arm 30.

When the end of each rocking arm 30 is depressed, the lower end is raised from the frame 35 as is indicated in part (a) of FIG. 5 where a "raised" rocking clamp arm 30 is shown dotted.

Once the suction tubes 27 have gripped the back of the uppermost transfer in the magazine 24, the frame 26 is raised and begins to pull the transfer through the aperture 36 of the frame 35. This is shown in (a) of FIG. 5. Lifting of the transfer continues as shown in (b) until opposed edges of the backing sheet spring into the grooves 39, 40 as in (c). Finally the vacuum is released thereby terminating the suction lift, the transfer 44 falls away from the ends of the suction tubes 27 and its edges lie flat in the grooves 39, 40 as shown in (d). As the transfer lifting frame 26 rises, the feet 28 of arms 29 (FIG. 1) disengage from the outer ends of rocking clamp arms 30 and the transfer is held firmly between the lower ends of arms 30 and the upper surface of the frame 35 of holder 9.

The transfer lifting frame 26 is raised and lowered by air cylinders the air supply to which is controlled by a suitably positioned cam. The magazine 24 is mounted on a table 45 and within the magazine is a platform (not shown) the height of which is adjusted so as to keep the top transfer in the stack, which rests on the said platform, in the magazine 24 at roughly the same distance below the plane in which the holders 9 move, by means of a lead screw 50 driven by a ¼ HP motor 46 via a clutch-brake device 47, reduction gearing 48 and a right-angled bevel gear box 49. The position of the top of the stack of transfers is sensed and control signals for the drive to the lead screw 50 are provided by a photocell so positioned that a beam of light which shines into it is interrupted when the top of the transfer stack reaches the desired height. On the table 45 there is also mounted a reserve magazine 25 and the table may be rotated about the axis of gear wheel 51 so as to bring reserve magazine 25 under transfer lifter 26 and to place magazine 24 in reserve when the latter magazine is exhausted. This is accomplished by suitable movement of a rod 52 which carries a rack 53 meshing with gear wheel 51. When in reserve, the magazine 24 is, of course, refilled with a stack of transfers by the operator.

When the transfer holder 9 now carrying a transfer is moved into position 10′ it is located over heater 54 where the design layer of the transfer, which embodies a heat-activatable ink of the type described in our copending British Patent Application No. 8361/72, is exposed to the heat from a ceramic IR heater element. The dwell time in each location is typically 1½ seconds and exposure to the heat from heater 54 for this period starts the activation process. In the next succeeding location 9′, the transfer design layer is exposed (typically again for 1½ seconds) to the heat from a similar heater 55 and this completes the activation process.

Position 8′ is spare and in position 7′, as previously indicated, the transfer is removed from its holder 9 by the transfer applying frame 20 and applied to the ware. During the downwards movement of frame 20 the feet 56 of the four spring-loaded arms 57 (only two are visible in FIG. 1) depress the outer ends of the arms 30 of the rocking clamps on the transfer holder 9 and thereby release the transfer.

As will be seen from FIG. 1, there is a hole 58 passing through the centre of each ware holder 17. This is to permit a lamp-photocell combination arranged in position 2′ to sense whether any ware is present in the holder in question. The lamp is arranged to direct a beam of light through the hole on to the photocell and when the holder 17 is empty there is a resulting signal from the photocell.

This signal is then used to instruct the transfer applying frame 20 and the transfer lifting frame 26 not to operate when the transfer holder (still carrying the transfer) reaches positions 7′ and 11′ respectively and also to instruct pairs of flaps at the mouths of heaters 54 and 55 to close to prevent also the transfer being exposed to heat when in positions 10′ and 9′. Only two of the four flaps are visible in FIG. 1 and these are shown at 59 and 60. The operation of the pressure pad 23 is also inhibited by this signal.

The "instructions" are given to the machine in the following way. Above the arms 8 is a disc 61 attached to shaft 2 and carrying six radially mounted "plunger blocks" each one positioned above and relating to one of the arms 8. Each block carries a plunger (one of which is shown at 63) and each plunger for each of the six index positions normally projects radially outwardly from its block as shown at 63. When a plunger projects outwardly in this way the operations of transfer application, transfer lifting, transfer holder loading and transfer exposure to the heaters are carried out normally.

When a plunger and block is at position 8', the ware holder, which the transfer holder associated with the plunger and block will meet at position 7', is at position 2'. If the ware is in position and the photocell is not illuminated, operations proceed normally and the two tables are indexed so as to bring the respective transfer and ware holders into positions 7' and 1'.

If the ware is missing, and the photocell is illuminated via the hole 58 at position 2', a signal is given to an air operated arm to move sharply and to push the plunger back into its block. It then remains retracted in this way until the block is being indexed between positions 9' and 8' during which process the inboard end of the plunger rides along a ramp and the plunger is again pushed outwardly. During the cycle of indexed positions from positions 7' to 9', the fact that the plunger is retracted means that the operations which normally occur during these stages of the indexing cycle are inhibited. Once the end of the plunger has ridden up the ramp between positions 9' and 8' and has been pushed radially outwards, it is available either to allow the normal cycle of operations to be executed or to be retracted once more by the operation of the air operated arm if the ware carrier at position 2' should again be empty.

The lamp-photocell combination used to sense the presence or absence of ware in a ware holder 17 may be replaced by a micro switch with a catswhisker sensing head.

What is claimed is:

1. A machine for applying transfer designs to a substrate or a succession of substrates comprising a plurality of radial arms spaced around a central shaft, a transfer holder mounted on each arm, means for indexing the arms through an angular distance equal to the angular separation of any two successive arms, a plurality of ware carriers for holding ceramic ware or other articles to which the transfer-designs are to be applied, means for intermittently moving the ware carriers so that each item of ware or each article is held stationary in succession in proximity to a transfer holder carried by a radial arm when said arm is stationary in one of its index positions, means at successive index positions of said radial arms (a) for withdrawing a transfer from a stack of stick-down transfers and conveying said transfer to said transfer holder, (b) for exposing said transfer in said transfer holder to a source of heat so as to activate a heat-activatable adhesive of said transfer, and (c) for removing the transfer from said holder and bringing said transfer into contact, backing sheet up, with an article in said ware carrier to provide at least "tacked" adhesion to the ware, means located at a subsequent stationary position of the ware carrier for applying pressure to the backing sheet so as to secure the transfer design to the article and means for removing the backing sheet from the transfer.

2. A machine according to claim 1, wherein the radial arms are equiangularly spaced around the central shaft.

3. A machine according to claim 2, wherein the withdrawal of the transfers is effected by a transfer lifting frame carrying suction tubes operative to contact and hold the backing sheet of the transfer uppermost in the stack and to convey said transfer into the transfer holder.

4. A machine according to claim 2, wherein the transfer removing means comprises a transfer applying frame carrying suction gallery and tack down plunger assembly operative to contact and hold the transfer in the holder and to apply said transfer to the article.

5. A machine according to claim 2, wherein the transfer holder comprises a frame carrying a plurality of clamping devices acting to clamp or release a transfer in response to movement of the frames carrying the suction tubes.

6. A machine according to claim 2, wherein the transfer holders are mounted on the respective radial arms in an adjustable manner allowing orientation of the holders relatively to said arms.

7. A machine according to claim 6, wherein the ware carriers are mounted in circumferentially spaced relation on a table rotatable in step with but in the opposite direction to the radial arms and arranged in a plane below the plane of the arms in such a manner that each arm in one of its index positions extends over the table.

8. A machine according to claim 2, wherein the means for applying pressure to the transfer comprises a resilient pressure pad actuated by a plunger arm.

9. A machine according to claim 2, wherein the means for removing the backing sheet of the transfer comprises a blast of high pressure air directed at a small angle to the surface of the ware.

10. A machine according to claim 2, which includes controlling means to maintain the uppermost transfer of the stack at approximately the same distance from the plane of the radial arms.

11. A machine according to claim 2, wherein the means activating the adhesive comprises a heater arranged at one or more of the index positions of the radial arms.

12. A machine according to claim 2, wherein the stack of transfers is contained in a magazine mounted on a table which carries a second magazine and is movable to bring one or the other of said magazines into the operative position.

13. A machine according to claim 2, which includes automatically acting means to determine the presence or absence of an article in each ware carrier and acting in such absence to prevent operation of the transfer lifting frame and transfer applying frame and to cause a transfer in the transfer holder to be shielded from the activating heat source.

* * * * *

UNITED STATES PATENT OFFICE

CERTIFICATE OF CORRECTION

Patent No. 3,986,920 Dated October 19, 1976

Inventor(s) Michael Wearing and Michael John Kite

It is certified that error appears in the above-identified patent and that said Letters Patent are hereby corrected as shown below:

Please insert the following in the heading:

-- [30] Foreign Application Priority Data

April 12, 1972 Great Britain 16861/72--

Signed and Sealed this

Eleventh Day of January 1977

[SEAL]

*Attest:*

RUTH C. MASON
*Attesting Officer*

C. MARSHALL DANN
*Commissioner of Patents and Trademarks*